US005971178A

United States Patent [19]

Ratcliff et al.

[11] Patent Number: 5,971,178

[45] Date of Patent: Oct. 26, 1999

[54] IMPACT DRIVEN HOIST

[75] Inventors: Bruce E. Ratcliff, 1308 Sunny Slope Ave., Belmont, Calif. 94002; Ralph A. Ratcliff, Belmont, Calif.

[73] Assignee: Bruce E. Ratcliff, Belmont, Calif.

[21] Appl. No.: 09/025,519

[22] Filed: Feb. 18, 1997

[51] Int. Cl.[6] ..... B66C 23/04; B66C 19/00; B21F 9/00

[52] U.S. Cl. ..... 212/271; 212/331; 212/250; 254/231

[58] Field of Search ..... 254/231, 232, 254/233, 229, 361, 358; 212/174, 271, 341, 171, 312, 225, 255

[56] References Cited

U.S. PATENT DOCUMENTS

| | | | |
|---|---|---|---|
| 721,946 | 3/1903 | Foster | 254/231 |
| 1,551,426 | 8/1925 | Pavella | 212/250 |
| 1,598,273 | 8/1926 | Fitch | 212/250 |
| 3,481,583 | 12/1969 | Ulbing | 254/361 |
| 4,157,171 | 6/1979 | Hasselås | 254/231 |
| 4,310,098 | 1/1982 | Dirksen | 212/255 |
| 5,623,751 | 4/1997 | Knutson | 254/231 |
| 5,720,400 | 2/1998 | Altizer, Sr. | 212/331 |

FOREIGN PATENT DOCUMENTS

| | | | |
|---|---|---|---|
| 2242101 | 4/1973 | Germany | 254/361 |
| 563939 | 9/1944 | United Kingdom | 254/358 |
| 903093 | 8/1962 | United Kingdom | 254/358 |

*Primary Examiner*—Christopher P. Ellis
*Assistant Examiner*—R. B. Johnson
*Attorney, Agent, or Firm*—Feix & Feix

[57] ABSTRACT

A hoist is constructed for powered drive by an impact tool. The hoist includes tension means for applying a force in tension to a load. Gear means are operatively associated with the tension means for producing a tension force in the tension means. The gear means include a gear element which provides a positive hold of the produced tension force when the gear means are not being driven. Impact fitting means are connected to the gear element for enabling the gear means to be power driven by an impact tool.

1 Claim, 11 Drawing Sheets

11
13
15
17
19
21
23
25
27
33
35
37
39
41
43
47

IMPACT DRIVEN HOIST

BACKGROUND OF THE INVENTION

This invention relates to hoists of the kind which apply a force in tension to a load. Hoists of the kind to which this invention relates incorporate gear apparatus shaped to provide a positive hold of the produced tension force when the gear apparatus is not being driven.

This invention relates particularly to a hoist having impact fitting means connected to the gear apparatus for enabling the gear apparatus to be power driven by an impact tool.

Hoists which are constructed for applying a force in tension to a load have a wide range of applications.

Such hoists may be used as load binders, as liking apparatus, or for pulling or otherwise repositioning a load.

Hoists are commonly powered by hand or by motor drive.

It is a primary object of the present invention to construct a hoist for a powered drive by an impact tool system of the kind commonly present on utility trucks and in shops.

SUMMARY OF THE INVENTION

In accordance with the present invention, a hoist is constructed for powered drive by an impact tool or wrench.

The hoist includes tension means for applying a force in tension to a load. The tension means may be a chain, a strap or a cable.

The hoist includes gear means which are operatively associated with the tension means for producing the tension force in the tension means.

The gear means include a gear element which provides a positive hold of the produced tension force when the gear means are not being driven in the direction to increase the tension force.

The hoist includes impact fitting means which are connected to the gear element for enabling the gear means to be power driven by an impact tool.

The hoist has an infinitesimal take up and let off.

The hoist can be used with an impact tool or with a rachet wrench.

The gearing of the hoist provides a positive hold. There is no slippage when the powered drive is discontinued.

The hoist is effective to apply a force in tension to a load at any position or inclination of the hoist with respect to the load.

The hoist of the present invention enables the hoist to be power driven by an impact tool system of the kind which is commonly available on utility trucks and in shop installations. For example, the drive may be from a pneumatically powered drive system or a hydraulically powered drive system or an electrically powered drive system.

In one specific embodiment of the present invention, the gear means comprise a rotatable screw gear and a non-rotatable nut gear which is driven longitudinally along the screw gear during rotation of the screw gear.

A load tensioning chain has one end connected to the nut gear, and the impact fitting means are connected to the screw gear in this specific embodiment.

In another specific embodiment of the present invention, the hoist includes a spool which is mounted for rotation within a frame. A load belt has one end connected to the spool and another end connected to an anchoring pin which is fixed in position on the frame.

In this embodiment the gear means comprise a spool drive gear mounted for rotation within the frame and a worm gear mounted for rotation within the frame. An impact fitting means is connected to the worm gear so that the gear means can be power driven by an impact tool.

Hoist apparatus and methods which incorporate the features noted above and which are effective to function as described above constitutes further, specific objects of the present invention.

Other and further objects of the present invention will be apparent from the following description and claims and are illustrated in the accompanying drawings, which by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appended claims.

BRIEF DESCRIPTION OF THE DRAWING VIEWS

FIG. 1 shows a hoist constructed in accordance with one embodiment of the present invention.

Figure 6:
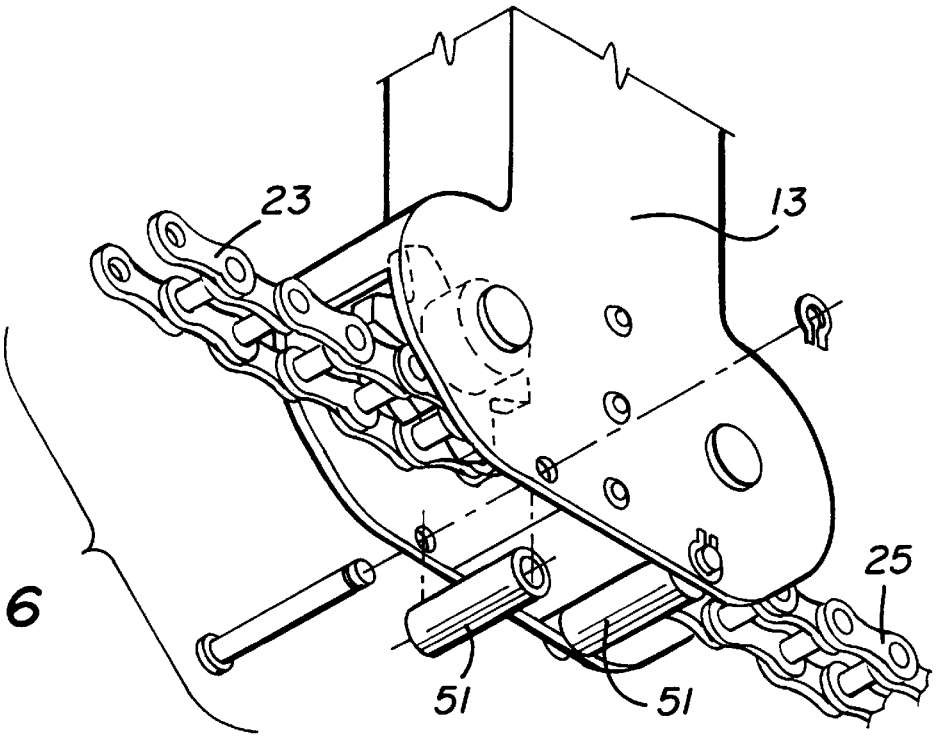

FIG. 6 is a fragmentary, enlarged view of an end portion of a second embodiment of a hoist constructed in accordance with the present invention. FIG. 6 shows an embodiment in which the housing includes rollers mounted in one end of the housing. The rollers are engagable with an opposed planar surface for minimizing rocking of the end of the hoist. The rollers permit some rolling, translational movement of the hoist with respect to an opposed planar surface.

Figure 7:
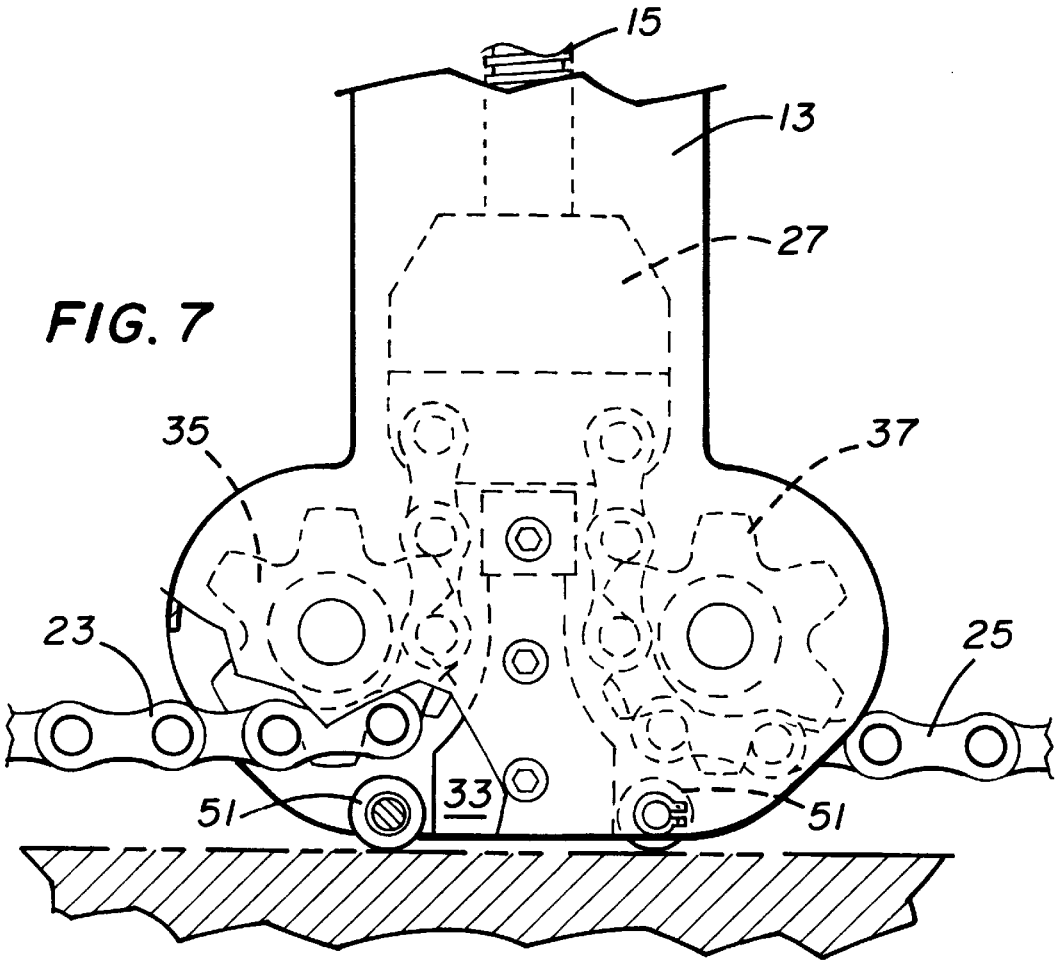

FIG. 7 is an enlarged, fragmentary side elevation view of the embodiment of the hoist shown in FIG. 6. FIG. 7 is partly broken away in parts to show details of construction. Some interior parts are shown in phantom outline to assist in illustrating the relevant structure.

Figures 1, 2, 3:
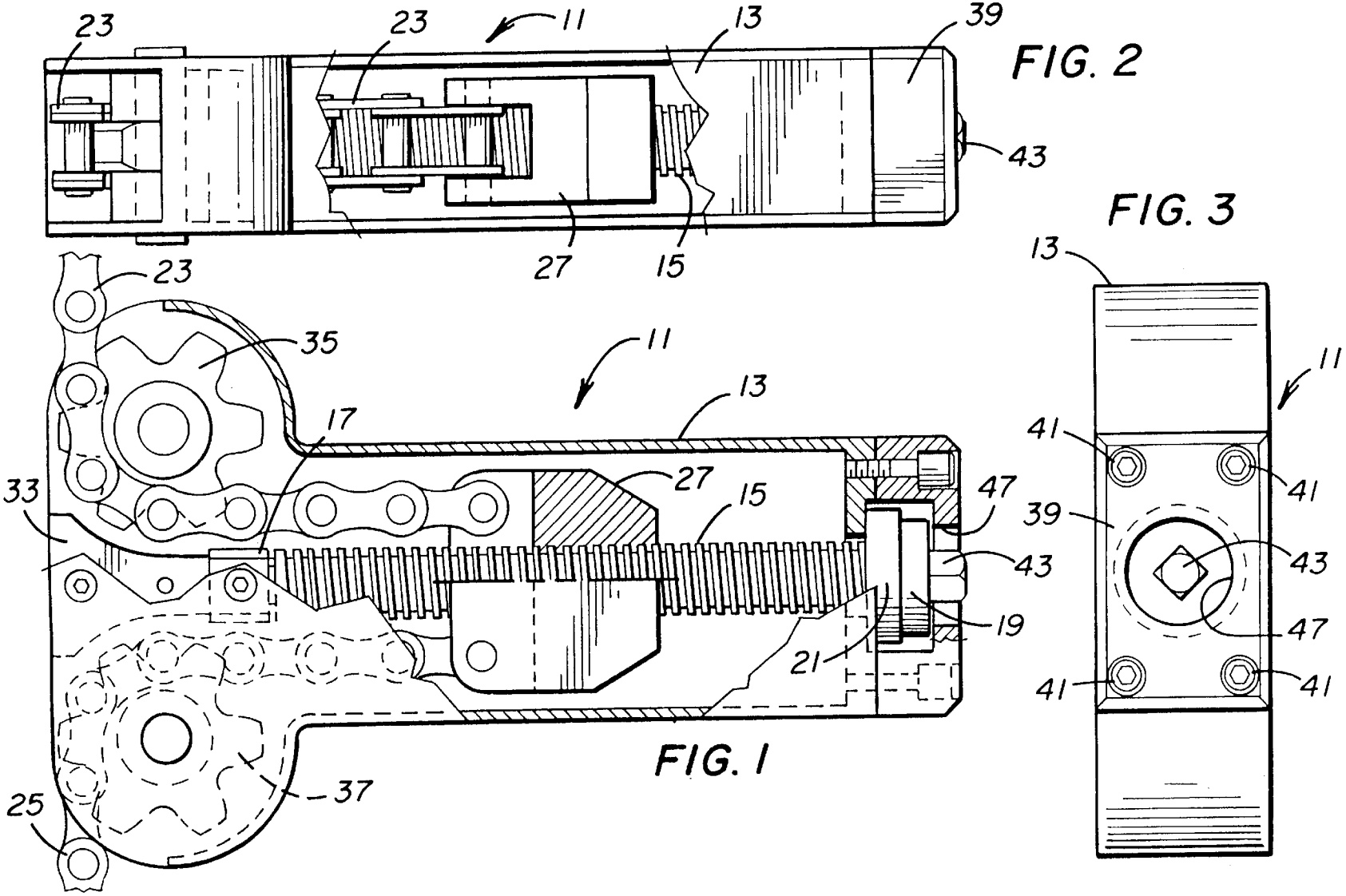
FIG. 1 is a side elevation view, partly broken away and in cross section to show details of construction, of a hoist constructed for powered drive by an impact tool.
FIG. 2 is a top plan view, partly broken away to show details of construction, of the hoist shown in FIG. 1.
FIG. 3 is a right end view of the hoist shown in FIGS. 1 and 2.
Figure 4:
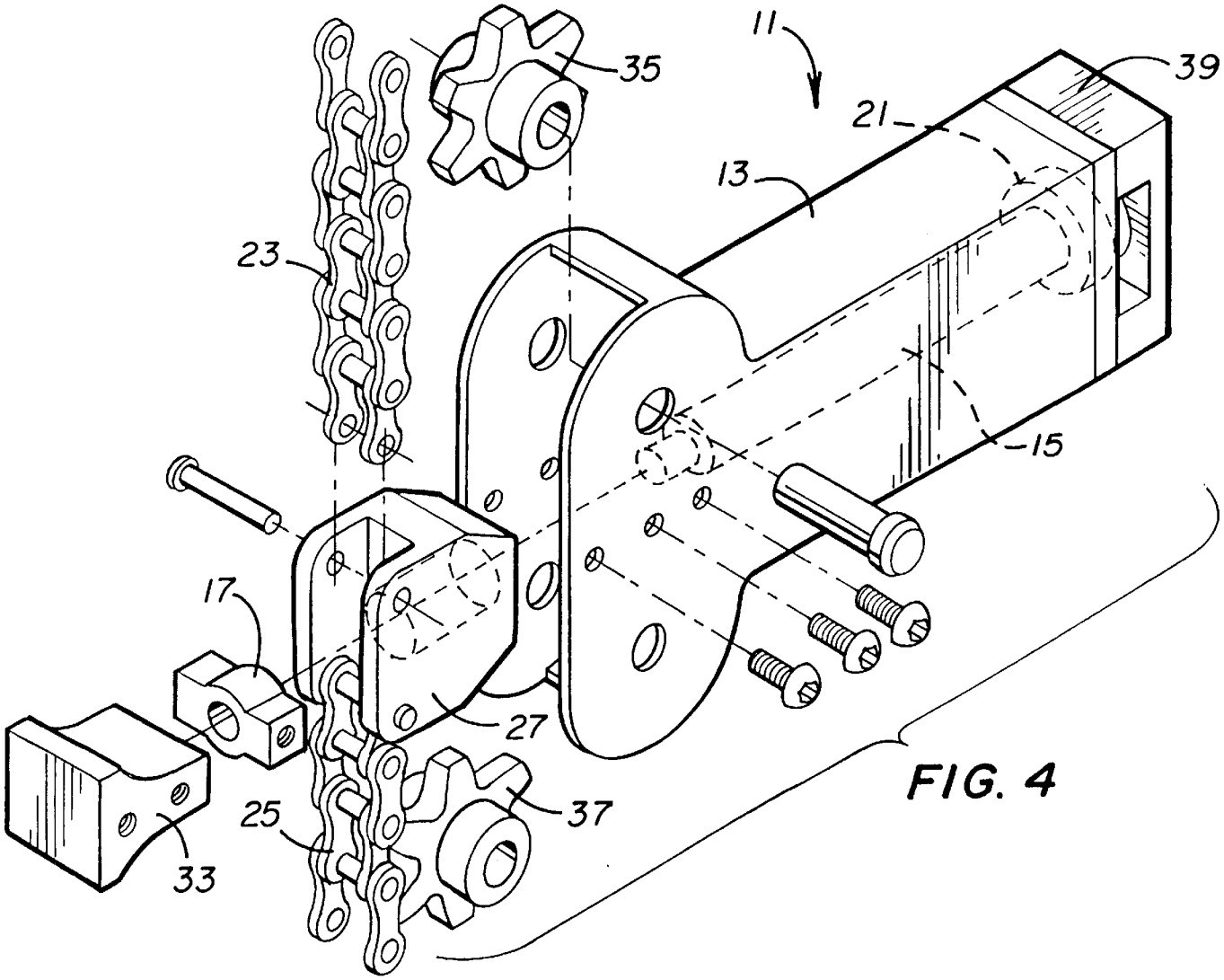
FIG. 4 is an isometric, exploded view of the hoist shown in FIGS. 1–3.
Figure 5:
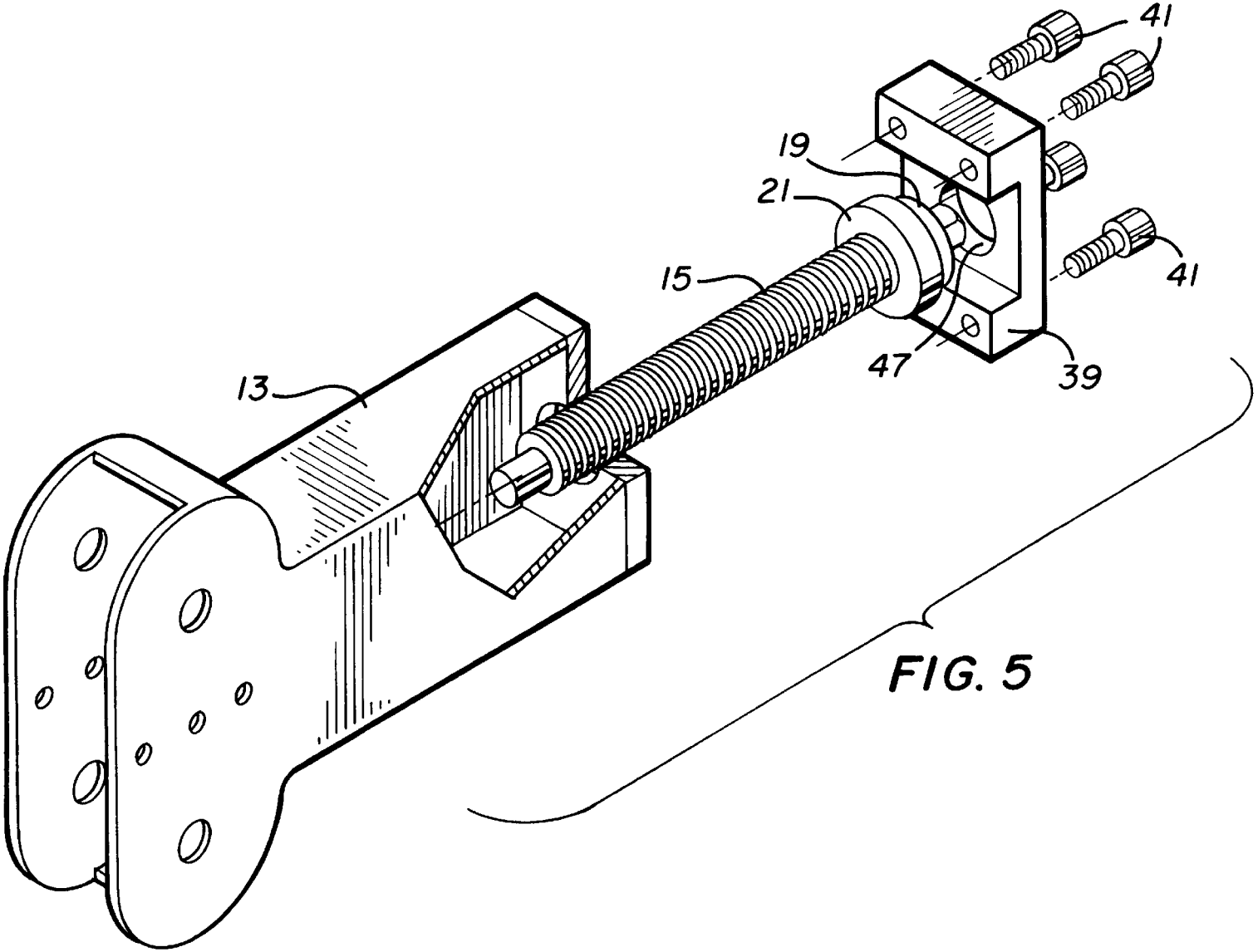
FIG. 5 is an isometric, exploded view showing details of the housing and screw drive and thrust bearing assembly of the hoist shown in FIGS. 1–4.
Figure 8:
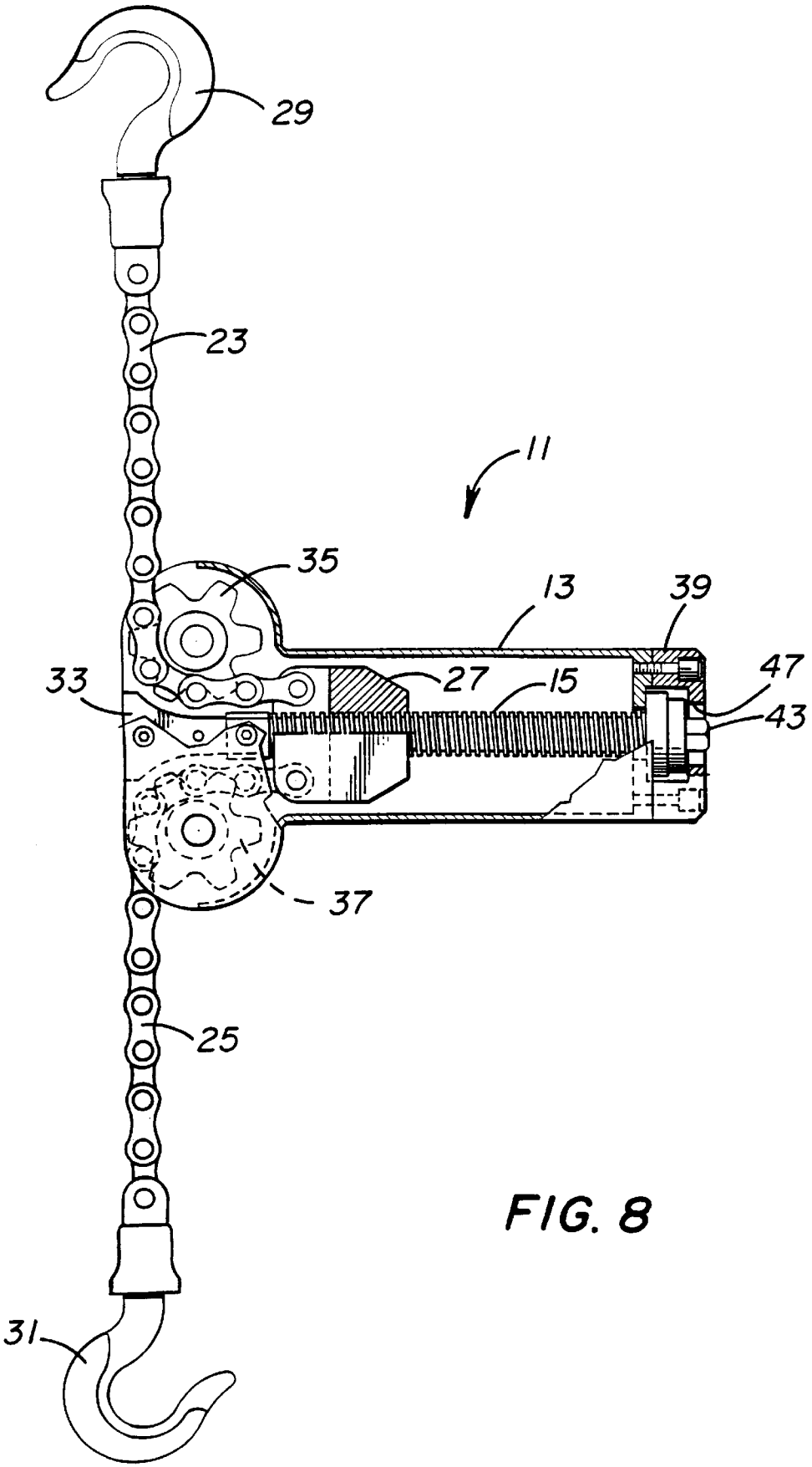

FIG. 8 is a side elevation view of the embodiment of the hoist shown in FIG. 1. FIG. 8 is somewhat reduced in size in order to show the entire lengths of the tension chains and to show the associated hooks of the hoist when the hoist is used as a load binder apparatus. In FIG. 8 parts of the housing have been broken away and some parts have been shown in cross section to illustrate details of construction. FIG. 8 shows the chains fully extended out of the housing.

Figure 9:
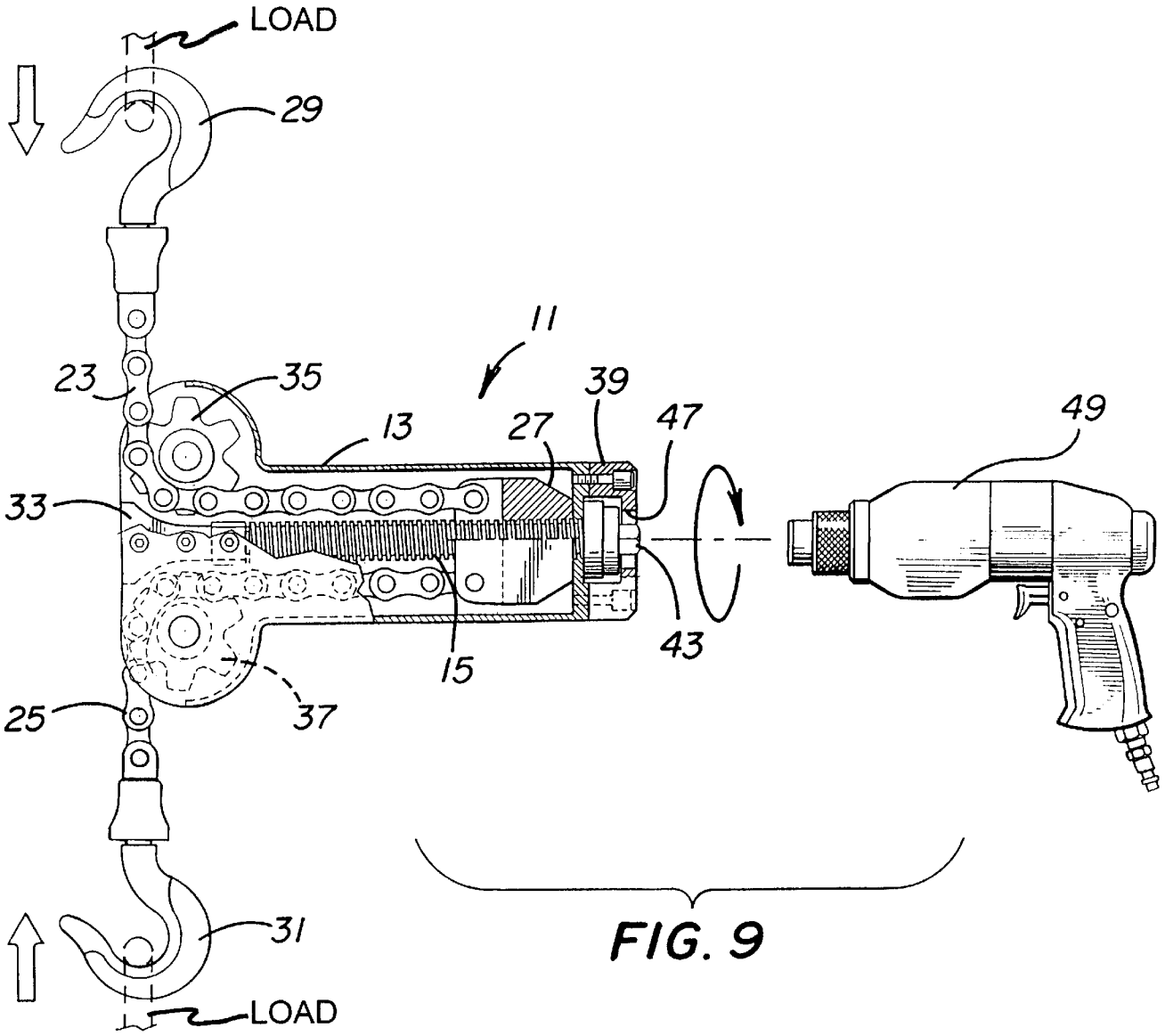

FIG. 9 is a side elevation view of the embodiment of the hoist shown in FIGS. 1 and 8 but also illustrates how the hoist is power driven by an impact tool. FIG. 9 shows the chains fully retracted within the housing with a load applied to each chain.

Figure 10:
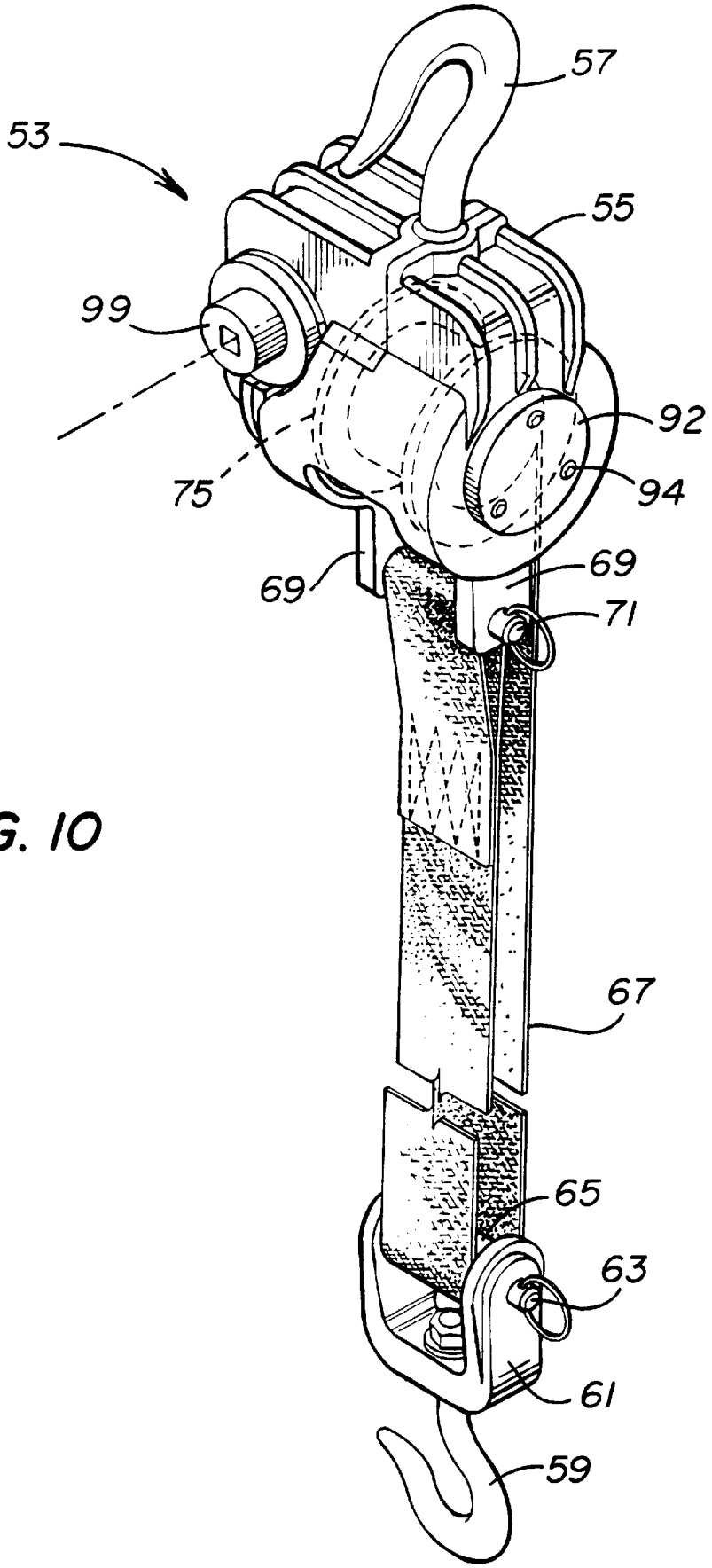

FIG. 10 is an isometric view showing another embodiment of a hoist constructed in accordance with the present invention. In FIG. 10 some of the structure within the interior of the frame of the hoist is illustrated in phantom outline to assist in an understanding of the mode of operation of the hoist.

Figure 11:
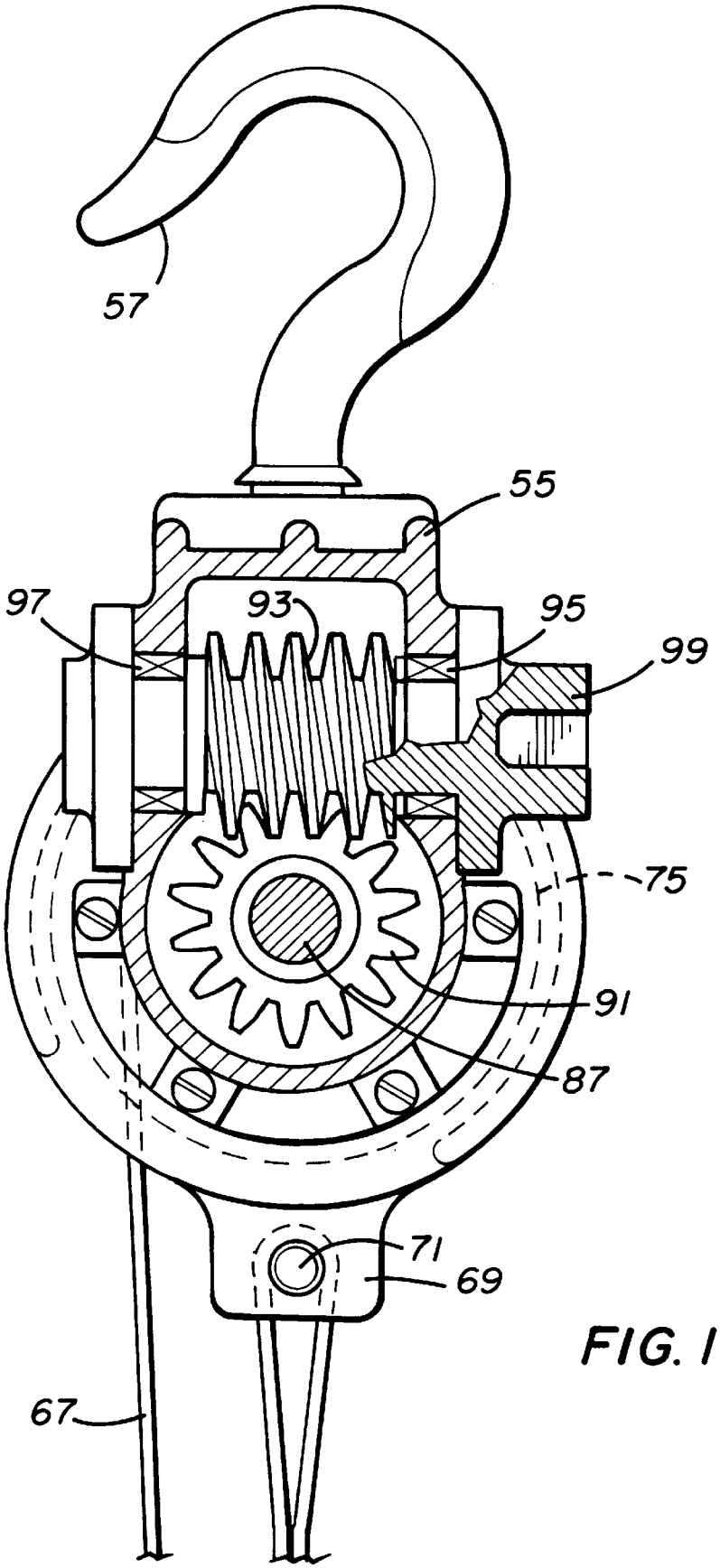

FIG. 11 is an enlarged, side elevation view, partly broken away and in cross section to illustrate details of construction, of the interior drive means of the hoist shown in FIG. 10. FIG. 11 is taken generally along the line and in the direction indicated by the arrows 11—11 in FIG. 12.

Figure 12:
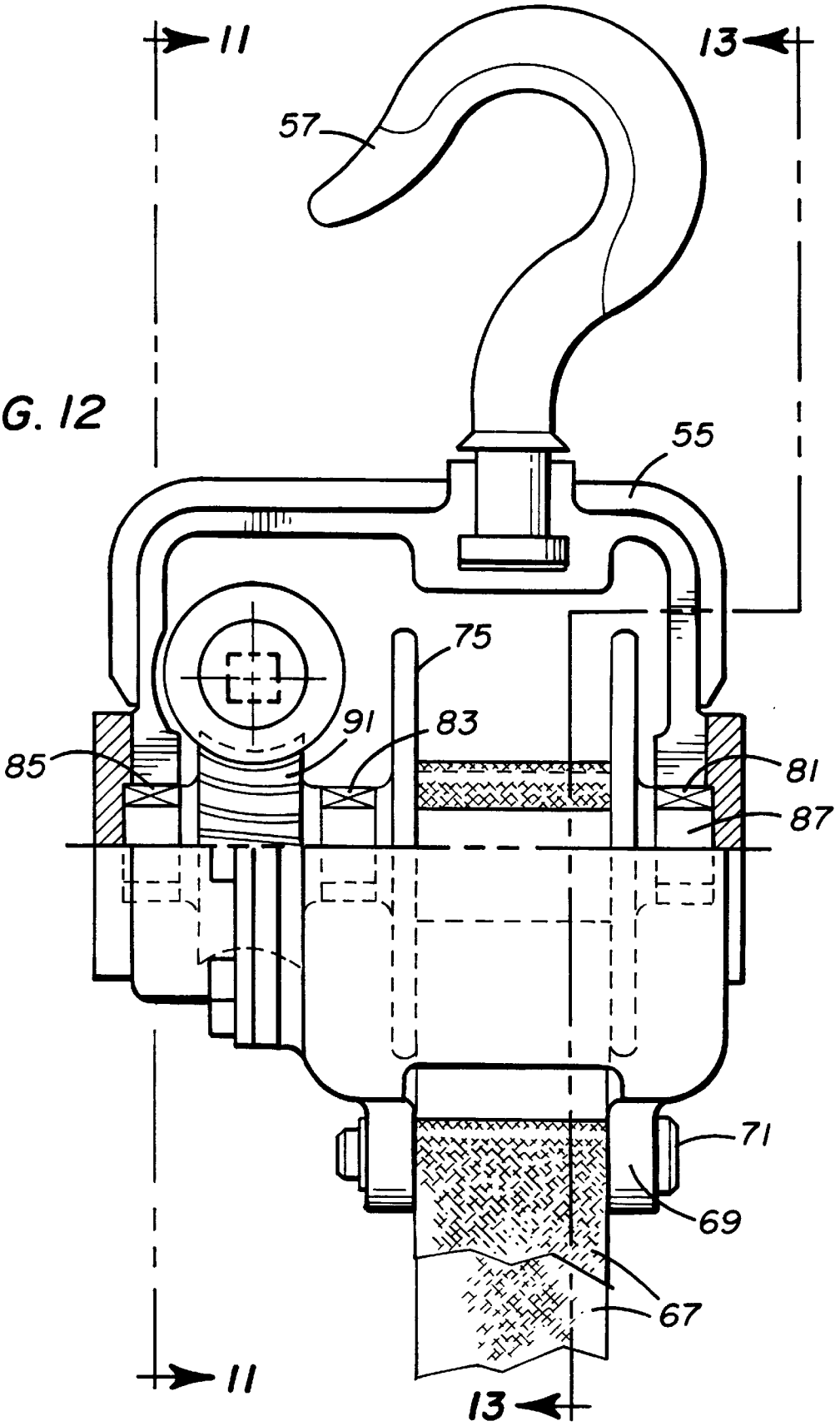

FIG. 12 is an enlarged front elevation view, partly broken away and partly in cross section to show details of construction, of the embodiment of the hoist shown in FIGS. 10 and 11.

Figure 13:
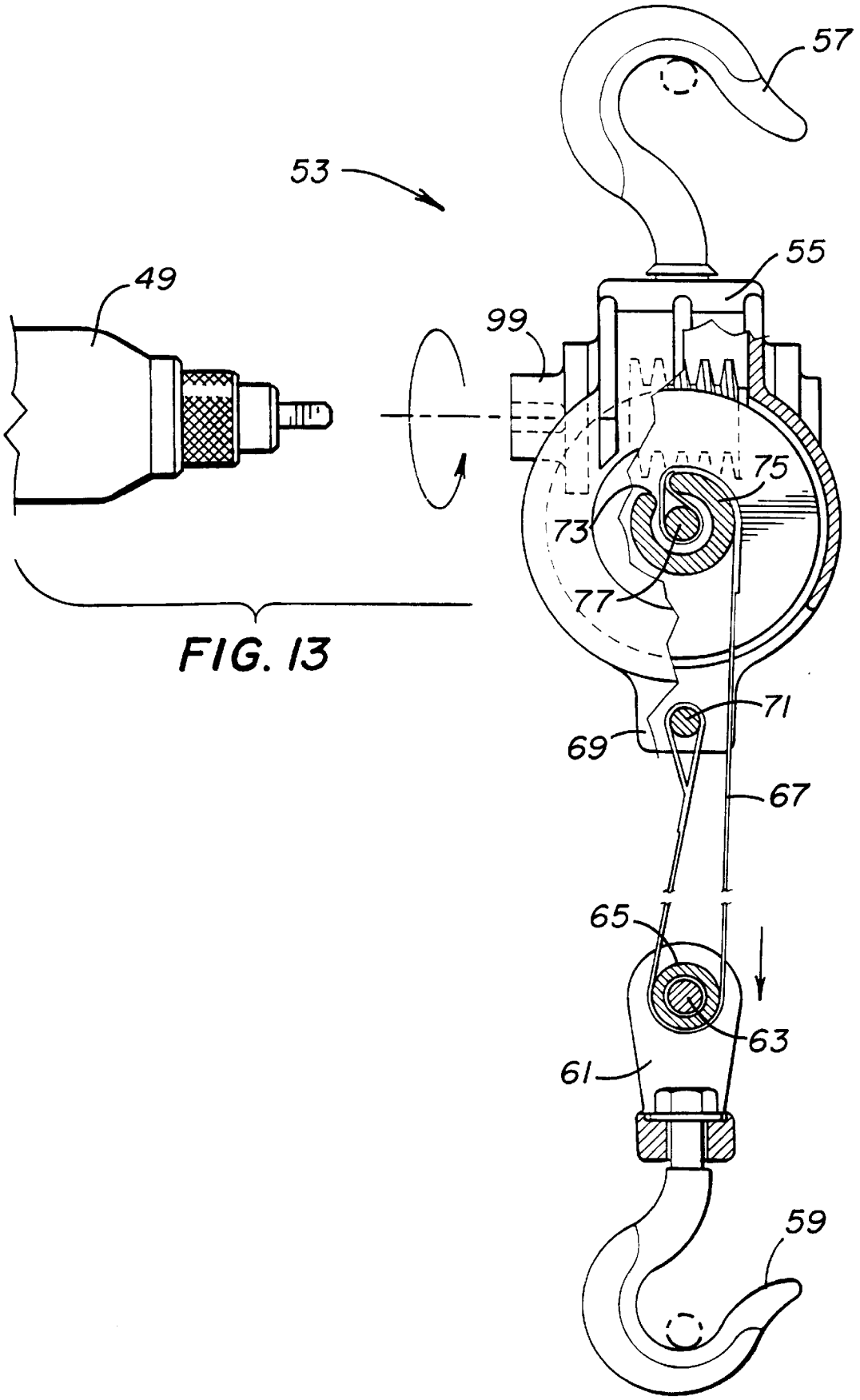

FIG. 13 is a side elevation view, with portions of the belt broken away to reduce the overall vertical height of FIG. 13, of the embodiment of the hoist shown in FIGS. 10–12. Parts of FIG. 13 are broken away along the offset line and in the direction indicated by the arrows 13—13 in FIG. 12. FIG. 13 shows how the hoist is power driven by an impact tool. FIG. 13 shows the load belt fully extended.

Figure 14:
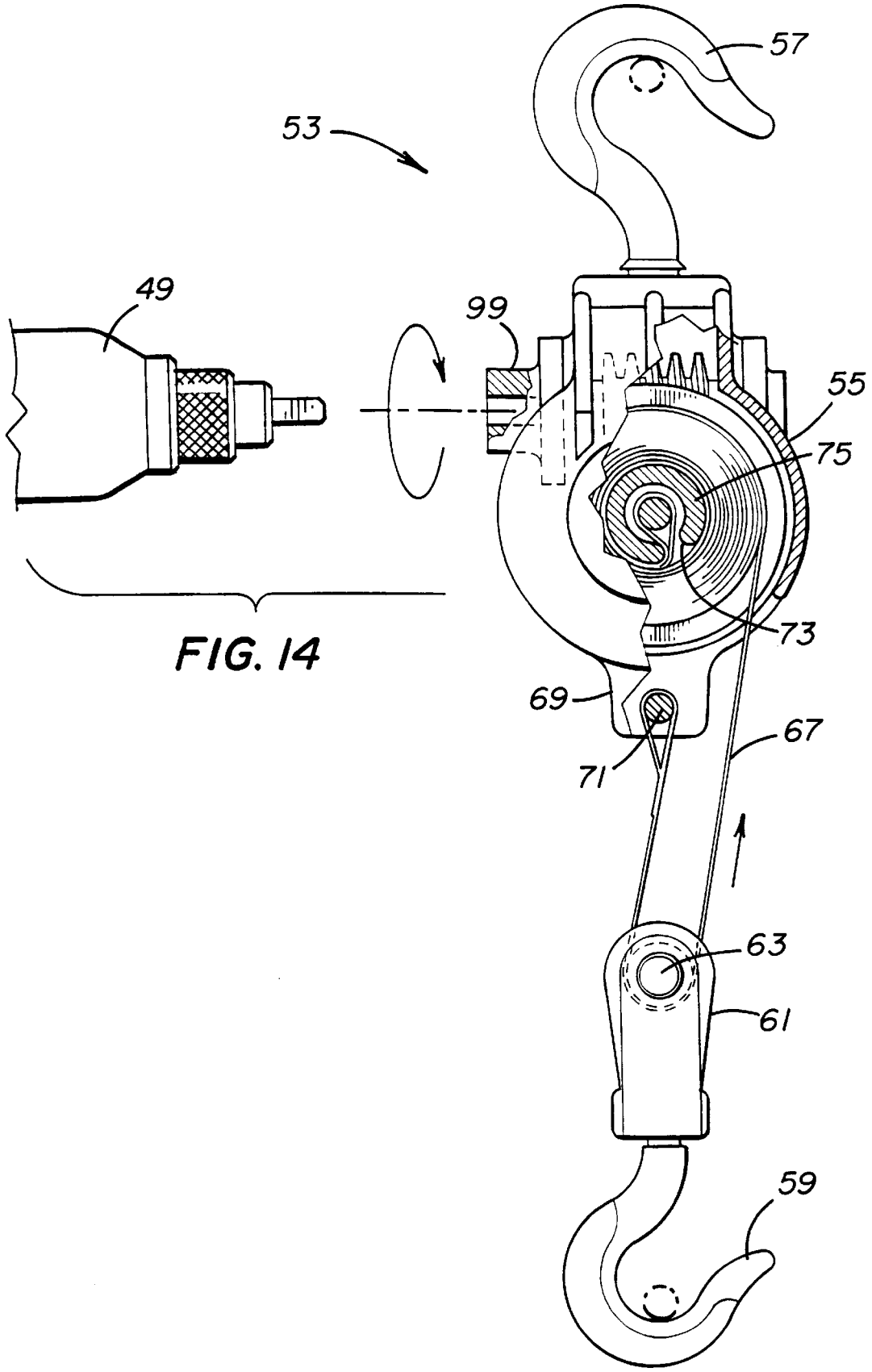

FIG. 14 is a side elevation view like FIG. 13 but showing the load belt fully retracted.

DETAILED DESCRIPTION OF THE PREFERRED EMBODIMENTS

A hoist constructed in accordance with one embodiment of the invention is indicated generally by the reference numeral 11 in FIGS. 1–5, 8 and 9.

FIGS. 1, 2, and 3 are basically in orthographic projection and show a side elevation in FIG. 1, a top plan in FIG. 2, and an end view in FIG. 3.

Portions of FIG. 1 and FIG. 2 are partially broken away, and portions of FIG. 1 are shown in cross section, to illustrate the details of construction of the hoist 11.

The hoist 11 comprises an outer housing 13 which serves as a main frame for the hoist 11.

A screw gear 15 is mounted for rotation within the housing 13 by a bearing 17 and by a thrust bearing 19.

The thrust bearing 19 is supported by a flange 21 so that the bearing 19 can function as a thrust bearing for taking up the axial thrust resulting from rotation of the screw gear 15 under the tension force produced in chains 23 and 25, as will be described in greater detail below. The chains 23 and 25 are, as illustrated in FIGS. 1–9, pin jointed link chains.

The bearings 17 and 19 mount the screw gear 15 for rotation without any longitudinal translation of the screw gear 15 within the housing 13.

A nut gear 27 has internal threads which engage with the external threads of the screw gear 15 so that rotation of the screw gear 15 causes the nut gear 27 to move longitudinally along the axis of rotation of the screw gear 15. The direction of movement of the nut gear 27 depends upon the direction of rotation of the screw gear 15.

Each of the chains 23 and 25 has one end connected to the nut gear 27. As best shown in FIGS. 8 and 9, the outer end of the chain 23 is connected to a hook 29, and the outer end of the chain 25 is connected to a hook 31. The hooks 29 and 31 are used for applying forces in tension to the load (see FIG. 9) engaged by the hooks 29 and 31.

A chain guide 33 (see FIG. 1, FIG. 4, and FIG. 7) is mounted within the housing 13, and idler gears 35 and 37 are also mounted within the housing 13 for guiding movement of the chains 23 and 25 into and out of the housing 13 during longitudinal movement of the nut gear 27 along the screw gear 15. As illustrated in FIGS. 1–9 in the drawings, the teeth of the idler gears 35 and 37 fit within individual links of the pin jointed link chains 23 and 25. This interfit of the teeth and the pin jointed links minimize twisting of each of the chains 23 and 25.

An end plate and thrust bearing retainer assembly 39 is attached to one end of the housing 13 by cap screws 41.

In accordance with the present invention, impact fitting means 43 are connected to one end of the screw gear 15 for enabling the screw gear 15 to be power driven by an impact tool such as the impact tool or wrench 49 shown in FIG. 9.

As illustrated in FIGS. 1 and 9, the end plate assembly 39 has an opening 47 which is large enough to permit a female fitting of the impact tool 49 to fit onto a male fitting of the impact fitting means 43.

As will be described below in reference to the hoist embodiment shown in FIG. 13, the impact fitting of the hoist may have a female fitting and the impact tool 49 may have a male fitting.

The opening 47 is small enough that the end plate assembly 39 provides a lip for retaining the thrust bearing 19 in its operative position when the screw gear 15 is rotated in either direction.

The hoist 11 is constructed for power drive by the impact tool 49. The impact tool may be a pneumatically powered drive system or a hydraulically powered drive system or an electrically powered drive system. Such pneumatic, hydraulic, and electrical powered impact drive systems are commonly available on utility trucks and in shops.

The chains 23 and 25 apply a force in tension to a load.

For some applications the chains 23 and 25 can be replaced by straps which are electrically nonconductive or by cables.

While two chains have been shown in the various embodiments, the hoist 11 can also incorporate a single chain and an anchor structure for applying a tension force to a load through a single chain.

The screw gear 15 and the nut gear 27 comprise gear means which are operatively associated with the chains 23 and 25 for producing the tension force in the chains 23 and 25.

The screw gear 15 has a shape which is effective to provide a positive hold of the produced tension force when the gears are not being driven in the direction to increase the tension force. The shape of the screw gear 15 (the mechanical advantage provided by the shape of the screw gear 15) is effective to prevent the load from driving the gearing in reverse when power is not being applied the screw gear 15.

The impact fitting means 43 enable the screw gear 15 and nut gear 27 to be power driven by an impact tool 49.

In one particular embodiment of the present invention the impact fitting 43 is limited to a half inch drive size to prevent an excessively large tension force from being applied to the chains of the hoist for the design and dimensions of a particular hoist. In that event the socket in the drive connection to the input drive will deform (mushroom) and prevent an excessively large tension force from being applied to the chains. The socket can be replaced at a minimal cost. The limiting of the power input by a particular maximum size of the input fitting is based on the design and dimensions of a particular hoist. Higher capacity hoists can be fitted with larger dimension input drive connections.

The hoist 11 illustrated in FIGS. 1–9 is particularly adapted for functioning as a load binder apparatus.

The hoist 11 of the present invention provides an infinitesimal take up and let off of the load.

The hoist 11 is effective to apply a force in tension to a load in any position or inclination of the hoist 11 with respect to the load.

In the embodiment of the hoist illustrated in FIGS. 6 and 7 the housing 13 has a pair of rollers mounted for rotation at one end of the housing 13. The rollers 51 are engagable with an opposed planar surface. The rollers 51 are effective to limit rocking of the housing 13 on the opposed planar surface, and the rollers 51 also permit some rolling, translational movement of the hoist 11 with respect to the opposed planar surface.

FIG. 8 shows the hoist 11 with the chains 23 and 25 fully extended out of the housing 13.

FIG. 9 shows the hoist 11 with the chains 23 and 25 substantially fully retracted within the housing 13.

FIGS. 10–14 show a hoist 53 constructed in accordance with another embodiment of the present invention.

The embodiment of the hoist 53 shown in FIGS. 10–14 is like the embodiments of the hoist 11 shown in FIGS. 1–9 in that the hoist 53 applies a force in tension to a load.

The tension force is produced by a gear apparatus which provides a positive hold of the produced tension force when the gear apparatus is not being driven in a direction to increase the tension force. The positive hold is provided by the shape of a gear element in the gear apparatus.

An impact fitting is connected to that gear element for enabling the gear apparatus to be power driven by an impact tool.

By connecting a power driven impact tool to the impact fitting, the impact tool can be selectively powered to drive the gear apparatus and to produce the desired tension in the tension apparatus.

The hoist 53 has an outer frame 55.

A hook 57 is connected to an upper end of the frame 55.

A second hook 59 is bolted to a U-shaped bracket 61. The hook 59 applies a tension force to a load to be lifted by the hoist 53.

A pin 63 is connected between the upper ends of the U-shaped bracket 61 and supports a rotatable shaft 65 (see FIG. 13).

A load lifting belt 67 is looped around the rotatable shaft 65.

The frame 55 includes two downwardly extending flanges 69.

An anchor pin 71 is mounted between the lugs 69 for anchoring one end of the belt 67.

As best shown in FIGS. 13 and 14, the other end of the belt 67 extends through a slot 73 in a rotatable spool 75 and is attached to a shaft 77

The spool 75 is rotatable to wind up the strap 67 to the substantially fully retracted position (shown in FIG. 14) and to let out the belt 67 to the substantially fully extended position (shown in FIG. 13).

The spool 75 for winding up the belt 67 is shown in phantom outline (within the interior of the frame 55) in FIG. 10.

As best shown in FIGS. 11 and 12, the spool 75 is mounted for rotation within the frame 55 by bearings 81, 83 and 85 which encircle a rotatable shaft 87 (see FIG. 11).

The spool 75 is connected to the rotatable shaft 87.

A spool drive gear 91 is also connected to the shaft 87. When the spool drive gear 91 is caused to rotate, the shaft 87 will be caused to rotate; and the spool 75 will therefore rotate with the spool drive gear 91.

As best illustrated in FIG. 11, a worm gear 93 is mounted for rotation within the housing 55 by bearings 95 and 97.

The worm gear 93 engages the spool drive gear 91. The gear set formed by the worm gear 93 and the spool drive gear 91 rotates the spool 75 either to cause the belt 67 to be retracted within the housing 55 or to permit the belt 67 to be paid out of the housing 55, depending upon the direction of rotation of the worm gear 93.

As shown in FIG. 10, an access plate 92 is removably mounted on the frame 55 by cap screws 94 for permitting access to the interior of that part of the hoist structure.

In accordance with the present invention, an impact fitting 99 is connected to the worm gear 93 so that the worm gear 93 can be power driven by an impact tool 49 (see FIGS. 13 and 14).

The shape of the worm gear 93, and the associated spool drive gear 91, provides a positive hold of the tension force produced in the strap 67 when the gearing is not being driven in a direction to increase the tension force.

The gearing provides enough of a mechanical advantage that the load carried by the strap 67 can not produce rotation of the gear set.

As illustrated in FIGS. 10–14, the impact fitting 99 of the hoist 53 may have a female shape and the associated fitting of the impact tool 49 may have a male shape.

When the impact tool 49 drives the gearing of the hoist in the direction indicated by the rotation arrow in FIG. 14, the belt 67 is wound up on the spool 75 to lift the load.

When the impact tool 49 drives the worm gear in the direction indicated by the arrow in FIG. 13, the gear set rotates the spool 75 in a direction to permit the load to be lowered.

The embodiment of the hoist 53 shown in FIGS. 10-14 enables the hoist 53 to be power driven by an impact tool.

The driving impact tool can be pneumatically powered, hydraulically powered, or electrically powered.

While we have illustrated and described the preferred embodiments of our invention, it is to be understood that these are capable of variation and modification, and we therefore do not wish to be limited to the precise details set forth, but desire to avail ourselves of such changes and alterations as fall within the purview of the following claims.

We claim:

1. A tensioning device comprising, an exterior housing providing a main frame for the tensioning device, said exterior housing having a first elongated portion, a screw gear having external threads and mounted for rotation within the first elongated portion of the exterior housing, bearing means for holding the screw gear in position within the elongated portion and for taking up axial thrust developed in the screw gear and for permitting rotation of the screw gear without any longitudinal translation of the screw gear within the housing, a nut gear having internal threads which engage with the external threads of the screw gear so that rotation of the screw gear causes the nut gear to move longitudinally along the axis of rotation of the screw gear with the direction of movement of the nut gear being dependent upon the direction of rotation of the screw gear, two pin jointed link chains, each having an inner end connected to the nut gear within the housing and each having an outer end disposed outside the housing for connection to a load, said housing having an enlarged end portion at a first end of the housing, two idler gears mounted for rotation within the enlarged and portion about axes of rotation which are disposed normal to a plane containing the axis of rotation of the screw gear, one of the two chains engaging with one of the idler gears and the other of the two chains engaging with the other of the two idler gears as the nut gear is moved longitudinally along the axis of rotation of the screw gear, stationary chain guide means mounted within the enlarged end of the housing between the two idler gears for guiding the chains into engagement with the idler gears, and wherein the idler gears and chain guide means coact with the two pin jointed link chains to minimize twisting of the chains when no tension is produced in the chains and thereby facilitate using the tensioning device at any position or inclination of the tensioning device, and screw gear drive means for applying a torque to rotate the screw gear, said screw gear drive mans being located at a second end of the exterior housing opposite the end having the enlarged end portion, and wherein the screw gear drive means are located on an axis of rotation which is substantially perpendicular to the direction of movement of the portions of the chains which extend out of the exterior housing and are also located at a distance from said portions of the chains which is substantially equal to the length of the exterior housing between said first and second ends of the exterior housing to thereby facilitate unobstructed access to the screw gear drive means by a portable tool.

* * * * *